US011486667B2

(12) United States Patent
Simek et al.

(10) Patent No.: US 11,486,667 B2
(45) Date of Patent: Nov. 1, 2022

(54) HAMMER ASSEMBLY OF THE AUTOMATIC MECHANISM OF A FIREARM

(71) Applicant: Ceska Zbrojovka A.S., Uhersky Brod (CZ)

(72) Inventors: Vladimir Simek, Uhersky Brod (CZ); Lukas Bednarik, Dolni Nemci (CZ)

(73) Assignee: Ceska Zbrojovka A.S., Uhersky Brod (CZ)

( * ) Notice: Subject to any disclaimer, the term of this patent is extended or adjusted under 35 U.S.C. 154(b) by 0 days.

(21) Appl. No.: 17/199,020

(22) Filed: Mar. 11, 2021

(65) Prior Publication Data

US 2021/0348866 A1 Nov. 11, 2021

(30) Foreign Application Priority Data

Apr. 3, 2020 (CZ) ..... PV2020-193

(51) Int. Cl.
*F41A 19/14* (2006.01)

(52) U.S. Cl.
CPC ..... *F41A 19/14* (2013.01)

(58) Field of Classification Search
CPC ..... F41A 19/13; F41A 19/14
See application file for complete search history.

(56) References Cited

U.S. PATENT DOCUMENTS 1,656,453 A * 1/1928 Iraj ..... F41C 7/02 42/52
2,356,726 A * 8/1944 Reising ..... F41A 19/30 89/184
2,427,304 A * 9/1947 Charles ..... F41A 19/31 89/149
2,962,936 A 6/1960 Muhlemann et al.
3,026,777 A * 3/1962 Wooderson, III ..... F41A 19/33 89/142
3,301,133 A 1/1967 Sturtevant
3,711,983 A * 1/1973 Allyn ..... F41A 19/32 42/75.03
4,270,437 A * 6/1981 Donovan ..... F41A 9/32 89/33.2
4,469,006 A * 9/1984 Teppa ..... F41A 19/31 89/149
2022/0011069 A1* 1/2022 Gourdet ..... F41A 19/13

FOREIGN PATENT DOCUMENTS

CN 201666759 8/2010
GB 613504 A * 11/1948
WO 9853267 11/1998

OTHER PUBLICATIONS

Search Report dated Jul. 7, 2020, from Corresponding Czech Patent Application No. PV 2020-193 (3 pages).

* cited by examiner

*Primary Examiner* — Joshua T Semick
(74) *Attorney, Agent, or Firm* — Hovey Williams LLP

(57) ABSTRACT

A hammer assembly of the automatic mechanism of a firearm, comprising a breech (4) that is pushed towards the barrel (3) by a return spring (6). On the breech (4) and/or in the breech case (3) a hammer carrier (10) is arranged in a sliding way that is pushed towards the breech by a striking spring (13). The hammer carrier (10) carries a hammer (11). The hammer (11) is arranged on the hammer carrier (10) movably between the front end position and the rear end position wherein between the front and rear end positions of the hammer (11), there is a play (F). The hammer (11) is pushed to the front end position by the hammer spring (12).

3 Claims, 4 Drawing Sheets

HAMMER ASSEMBLY OF THE AUTOMATIC MECHANISM OF A FIREARM

RELATED APPLICATIONS

This application claims the priority benefit of Czech Patent Application Serial No. PV 2020-193 entitled "Hammer assembly of the automatic mechanism of a firearm," filed Apr. 3, 2020, the entire disclosure of which is incorporated herein by reference.

TECHNICAL FIELD

The invention relates to a hammer assembly of the automatic mechanism of a firearm comprising a breech that is pushed towards the barrel by a return spring, and on the breech and/or in the breech case, a hammer carrier is arranged in a sliding way that is pushed towards the breech by a striking spring, and the hammer carrier carries the hammer.

PRIOR ART

Known drives of the self-loading function of a firearm either utilize the shot impulse, impulse of dust gases harvested from the barrel, drive by the pushing force of the bullet, mixed drives and drives with an external energy source.

Breeches driven by harvested gases are mostly locked and are used for weapons of larger gauges.

Further, dynamic or braked breeches are used, driven by the shot force acting upon the cartridge bottom, which are generally used for lower power weapons.

There are a number of braked systems. They can be classified into the following categories:

- friction braked breech—the breech is decelerated by further resistance during the movement of a friction insert in the weapon case
- breech braked by dust gases—gases harvested from the barrel during the shot, which subsequently brake the breech
- breech braked by mass reduction—the breech is braked by a transmission inserted between the breech and the weapon case, or between the breech block and the breech block carrier
- breech braked by pre-ignition—used in systems firing from the rear position of the breech, a shot is fired during insertion of the cartridge in the cartridge chamber
- breech braked by split mass—the breech is divided into two parts, the first part fires immediately after insertion of the cartridge, the other part, still moving forwards, then decelerates the breech accelerated by the shot force by an impact. It is used for systems firing from the rear position of the breech.

Designs are known that aim to reduce the recoil after a shot. For example, the structure according to the document US2006260461 deals with stabilization of a weapon and recoil reduction in such a way that shot gases act upon the movable parts in both directions, i.e. upon the movable container/chamber in the opposite direction to that of the shot and on the movable body in the same direction as the shot.

It is an object of the invention to provide such an automatic mechanism assembly of a firearm that will be simpler, more cost efficient to produce than existing designs, and that will contribute to a considerable reduction of the recoil after a shot at the same time.

DISCLOSURE OF INVENTION

The said object is achieved through a hammer assembly of the automatic mechanism of a firearm comprising a breech that is pushed by a return spring towards a barrel, and on the breech and/or in the breech case, a hammer carrier is arranged in a sliding way that is pushed by a striking spring towards the breech, and the hammer carrier carries a hammer, according to the invention the principle of which is the hammer is arranged on the hammer carrier movably between a front end position and a rear end position while between the front and rear end positions of the hammer, there is a play and the hammer is pushed to the front end position by the hammer spring.

The hammer assembly of the automatic mechanism of a firearm according to the invention brings a reduction of the breech weight as compared to known systems, which contributes to considerable reduction of the recoil after a shot. At the same time, a weight reduction of the entire firearm is achieved.

The recoil reduction is achieved through the fact that it is only the hammer assembly that gets to the rear position as it has a higher speed after an impact than the breech. The breech itself is then stopped, or at least braked by the hammer assembly, which returns from the rear position forwards, against the breech movement.

In a preferred embodiment, the front end position and the rear end position of the hammer are delimited with stops.

In another preferred embodiment, the striking spring is arranged concentrically around the return spring.

In still another preferred embodiment, the hammer can be fixed to the hammer carrier.

BRIEF DESCRIPTION OF DRAWINGS

The invention will be described in a more detailed way using a particular embodiment of the hammer assembly of the automatic mechanism of a firearm according to the invention, shown in drawings wherein individual figures illustrate.

DESCRIPTION OF PREFERRED EMBODIMENTS

Figure 1:
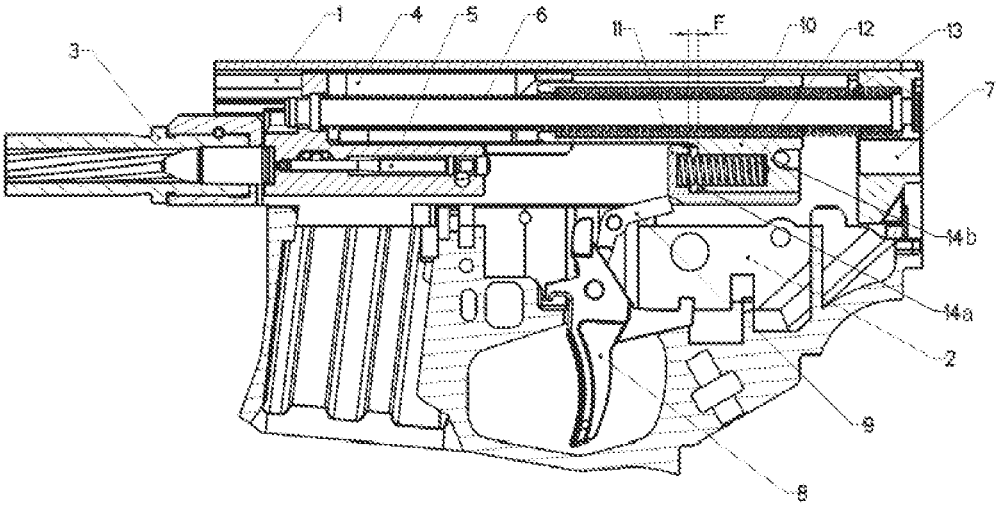
FIG. 1—a cross-section of a firearm with the inventive hammer assembly, the firearm being in the initial state with the striking mechanism tensioned.

FIG. 1 shows a cross-section of a firearm with the hammer assembly according to the invention in the initial state with the striking mechanism tensioned.

The firearm has a breech case 1 that the barrel 3 is attached to and a trigger mechanism case 2. In the breech case 1, a breech 4 is arranged, which is pushed towards the barrel 3 by a return spring 6. On the breech 4 and at the same time in the breech case 1, a hammer carrier 10 is arranged in a sliding way, which is pushed in the shooting direction towards the breech 4 by a striking spring 13. On the hammer carrier 10, a hammer 11 is arranged in such a way that it can be moved between the front end position and the rear end position. Between the front end position and the rear end position of the hammer 11, there is a play F and the hammer 11 is pushed by a hammer spring 12 of the to the front end position.

The hammer 11 is, together with the carrier 10, held in the initial position (see FIG. 1) by the catch 9 of the hammer 11.

The front end position and the rear end position of the hammer 11 are delimited with stops that are arranged on the hammer carrier 10.

The striking spring 13 is arranged concentrically around the return spring 6.

In an embodiment, which is not shown here, the hammer 11 may be firmly fixed to the hammer carrier 10. Such an embodiment is suitable when cartridges with a lower power than that the inventive assembly has been designed for are used, e.g., when the firearm is converted to training ammunition.

Figure 2:
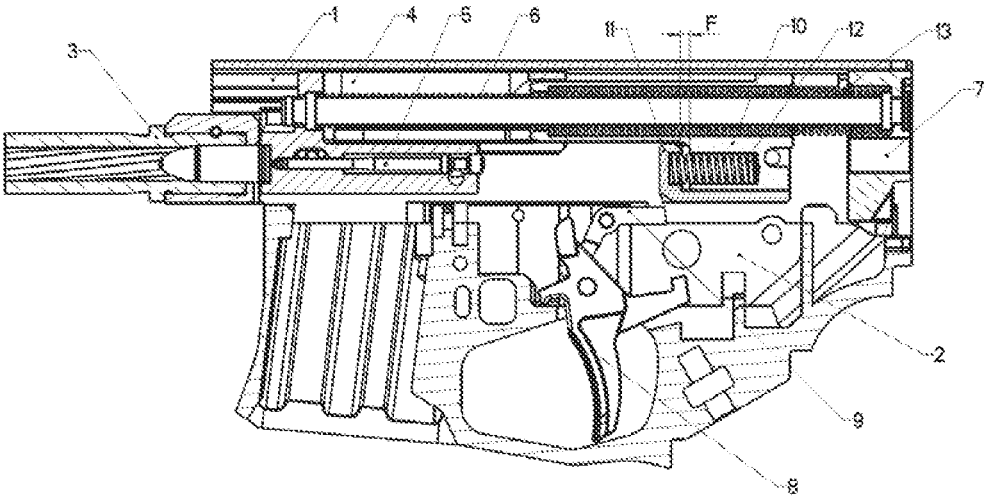
FIG. 2—the same firearm at the moment of actuation of the striking mechanism.

When the trigger 8 is initially pulled (see FIG. 2), the catch 9 of the hammer 11 is pivoted and the carrier 10 with the hammer 11 starts to move towards the breech 4 by the action of the striking spring 13.

Figure 3:
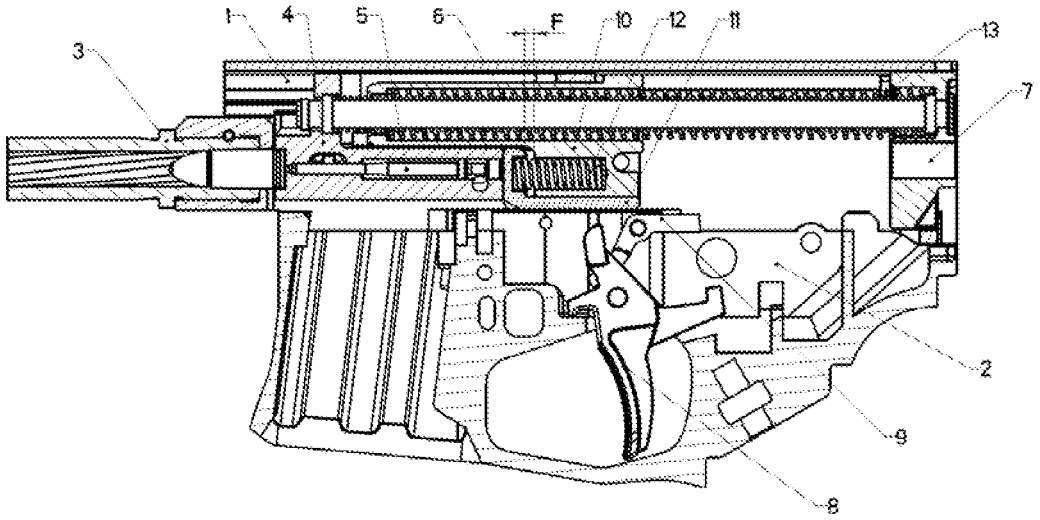
FIG. 3—the same firearm at the moment of initiation of the cartridge primer.

FIG. 3 shows the moment of the contact of the hammer 11 with the striker 5 and breech 4. A shot is fired and the breech 4, together with the hammer 11, starts to move by the shot force backwards against the shooting direction. The hammer carrier 10 still moves in the shooting direction until the play F between the hammer carrier 10 and the hammer 11 is eliminated.

Figure 4:
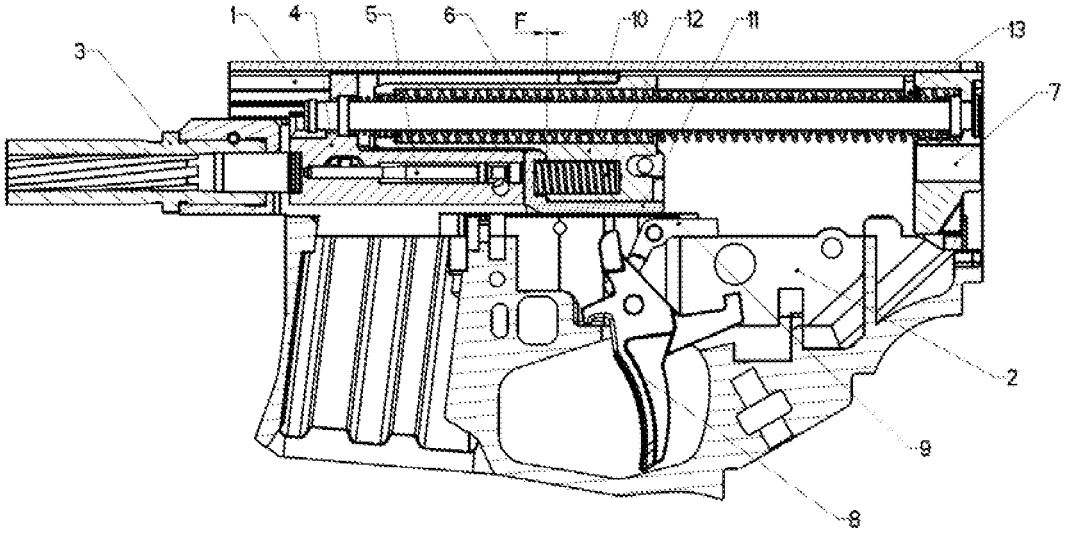
FIG. 4—the same firearm at the moment of deceleration of the breech.

At the moment of the impact between the hammer carrier 10 and the hammer 11 (see FIG. 4), the breech 4, which is moving together with the hammer 11 at the particular moment, is decelerated.

Besides decelerating the breech 4, the impact also changes the movement direction of the hammer carrier 10 and causes its acceleration to a higher speed than that of the breech 4.

Figure 5:
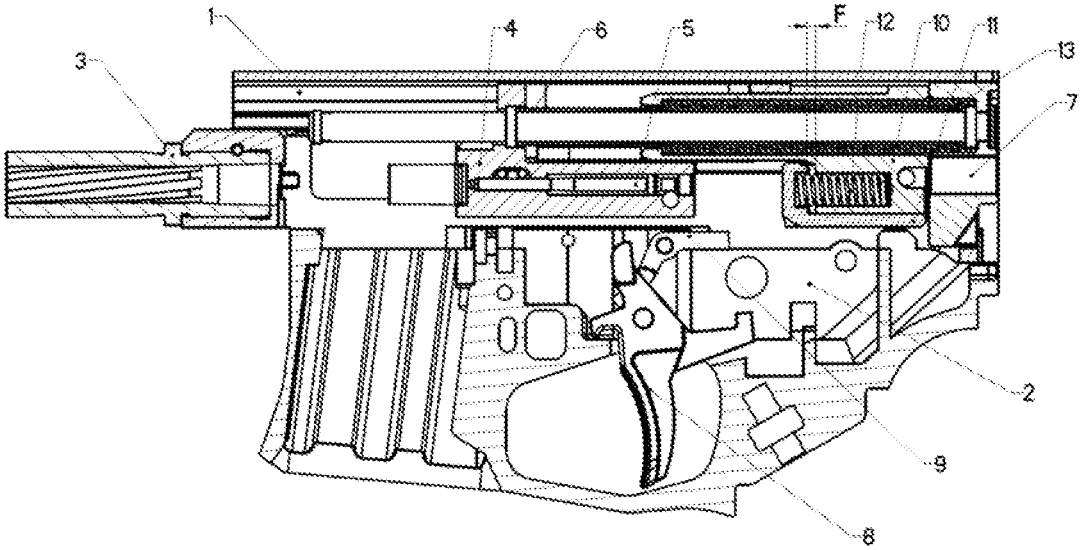
FIG. 5—the same firearm at the moment of impact of the hammer assembly to the rear position to the shock buffer.
Figure 6:
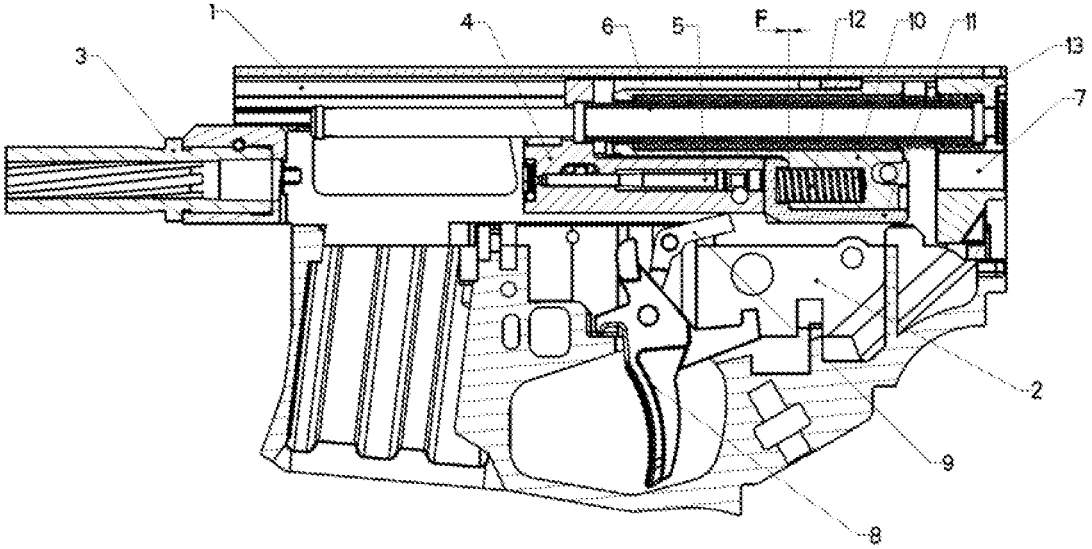
FIG. 6—the same firearm at the moment of breech deceleration by the impact of the hammer carrier to reduce the recoil.
Figure 7:
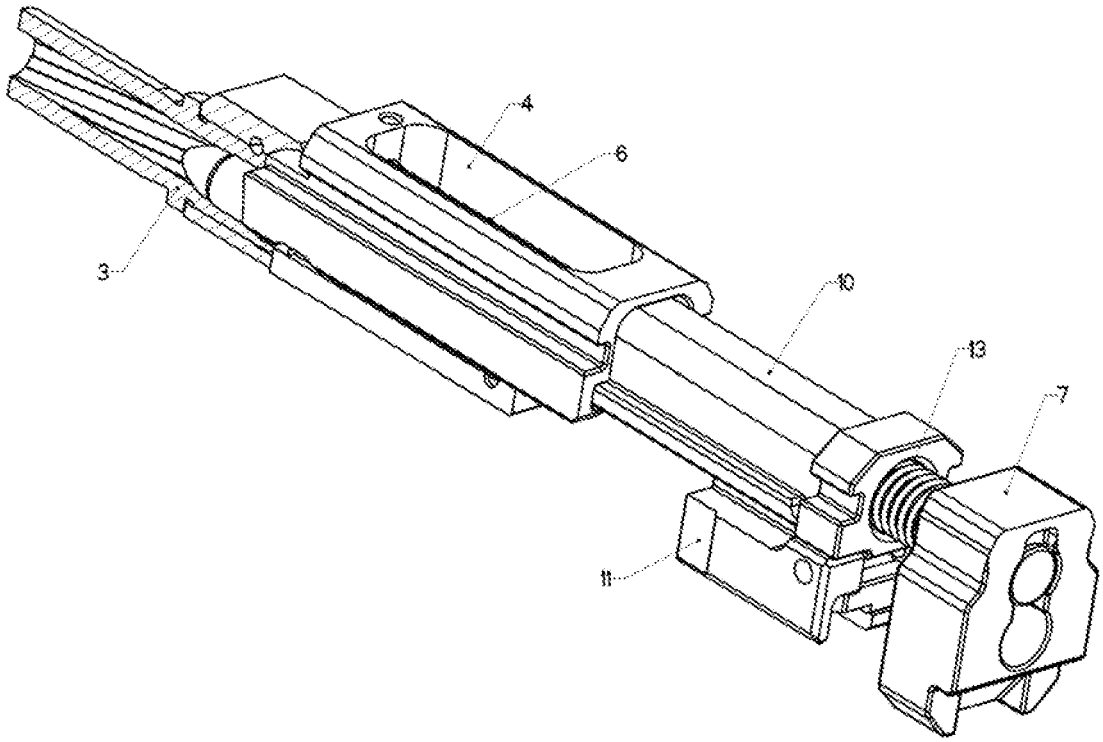
FIG. 7—an axonometric view of the breech and carrier with the hammer.

Thus, the carrier 10 with the hammer 11 will get to the rear position delimited with the shock buffer 7 (see FIG. 5) during a shorter time period than the breech 4, and will start to move in the shooting direction against the movement of the breech 4. Subsequently, the carrier 10 and the hammer 11 will get in contact with the breech 4 (see FIG. 6). Thus, the breech 4 will not get to the rear position defined by the shock buffer 7, but is stopped by the impact of the carrier 10 and hammer 11. This considerably reduces the recoil perceived by the shooter.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

INDUSTRIAL APPLICABILITY

The system of a breech braked by the hammer assembly according to the invention is applicable in self-loading weapons, especially as a replacement of conventional dynamic breeches. Maintaining simplicity and reliability, it brings a considerable weight saving and at the same time a recoil reduction. Compared to other braked, or locked systems, it is then significantly easier to produce and maintain.

The invention is especially applicable to firearms for lower power cartridges, used in machine guns, as e.g., 9×21 or 45 Auto. For the use of cartridges with an even lower power, e.g., 22 Long Rifle, the system can be easily adapted through a fixed connection of the hammer and hammer carrier. This way, the breech braking function is disabled in a targeted manner.

LIST OF REFERENCE SIGNS

1 breech case
2 trigger mechanism case
3 barrel
4 breech
5 striker
6 return spring
7 shock buffer
8 trigger
9 hammer catch
10 hammer carrier
11 hammer
12 hammer spring
13 striking spring

The invention claimed is:

1. A hammer assembly of an automatic mechanism of a firearm, comprising a breech that is pushed towards a barrel by a return spring, a hammer carrier movably arranged relative to the breech and pushed towards the breech by a striking spring, and the hammer carrier carries a hammer, wherein the hammer is arranged on the hammer carrier movably between a front end position and a rear end position, wherein there is a play between the front end position and the rear end position of the hammer and the hammer is pushed by a hammer spring to the front end position.

2. The hammer assembly according to claim 1, wherein the front end position and the rear end position of the hammer are defined with stops.

3. The hammer assembly according to claim 1, wherein the striking spring is arranged concentrically around the return spring.

* * * * *